US005983861A

United States Patent [19]

Nishio et al.

[11] Patent Number: 5,983,861

[45] Date of Patent: Nov. 16, 1999

[54] THROTTLE VALVE CONTROL DEVICE AND CONTROL METHOD THEREOF

[75] Inventors: Susumu Nishio; Mitsuhiro Miyake; Takuya Matsumoto, all of Kyoto; Toru Hashimoto, Aichi, all of Japan

[73] Assignee: Mitsubishi Jidosha Kogyo Kabushiki, Japan

[21] Appl. No.: 09/049,670

[22] Filed: Mar. 27, 1998

[30] Foreign Application Priority Data

Mar. 31, 1997 [JP] Japan ..... 9-098099

[51] Int. Cl.[6] ..... F02D 7/00

[52] U.S. Cl. ..... 123/399; 123/350; 123/361; 123/396

[58] Field of Search ..... 123/361, 350, 123/399, 396

*Primary Examiner*—John Kwon
*Attorney, Agent, or Firm*—Rossi & Associates

[57] ABSTRACT

A throttle valve control device is provided which includes a throttle valve mounted in an intake pipe of an internal combustion engine, an actuator which drives the throttle valve so as to change an opening of the throttle valve, an operating condition sensor which detects operating conditions of the internal combustion engine, an accelerator sensor which detects an accelerator pedal position that represents an amount by which an accelerator pedal is depressed by a driver, and a control unit for controlling the throttle valve. The control unit includes a first setting circuit that sets a first target opening of the throttle valve based on the accelerator pedal position detected by the accelerator sensor, a second setting circuit that sets a second target opening of the throttle valve based on the accelerator pedal position detected by the accelerator sensor, and the operating conditions of the engine detected by the operating condition sensor, and a control circuit that compares the first target opening with the second target opening, and controls the actuator based on the larger one of the first target opening and second target opening.

9 Claims, 5 Drawing Sheets

THROTTLE VALVE CONTROL DEVICE AND CONTROL METHOD THEREOF

FIELD OF THE INVENTION

The present invention relates to a throttle valve control device for controlling a throttle valve of an internal combustion engine, and to a method of controlling the throttle valve.

BACKGROUND OF THE INVENTION

In recent years, a control device for controlling a throttle valve mounted in an engine of an automobile is provided with a system for controlling an opening of a throttle valve in response to an electric control signal based on the amount of depression of an accelerator pedal (accelerator pedal position). Such a system is called drive-by-wire (DBW) control system.

A known example of the control device, which is constructed in the simplest form as shown in FIG. 6, is adapted to transmit a control signal which fully represents or corresponds to the amount of depression of the accelerator pedal (accelerator pedal position). In this case, the control device principally consists of a sensor (accelerator position sensor) 10 for detecting the amount by which the accelerator pedal is depressed by a driver, a motor (throttle actuator) 20 for driving the throttle valve, and a driver-by-wire control unit 30 for converting a signal (indicative of the accelerator pedal position) received from the accelerator position sensor 10, into a corresponding drive signal used for driving the motor 20.

Another known example of the control device, which is in FIG. 7, includes an electronic control unit (ECU) 40 in addition to the above-described components 10–30, and is capable of driving the throttle valve with higher accuracy. In this example, the ECU 40 sets a target throttle opening (target TPS), based on a pseudo accelerator pedal position obtained by correcting a signal (indicative of an accelerator pedal position) from the accelerator position sensor 10 in accordance with operating conditions of the engine and other information. The drive-by-wire control unit 30 converts an output signal of the ECU 40 representing the target throttle opening TPS, into a drive signal to be transmitted to the motor 20.

If the ECU 40 is interposed between the accelerator position sensor 10 and the drive-by-wire control unit 30, the throttle valve can be driven more appropriately, but a delay arises in the response of the throttle opening to the current position of the accelerator pedal, due to computing time taken by the ECU 40 to compute the target throttle opening TPS, and time required for transmitting signals between the ECU 40 and the drive-by-wire control unit 30 and between the ECU 40 and the accelerator position sensor 10. This may make a driver feel uncomfortable when he/she depresses the accelerator pedal (namely, when the vehicle is accelerated), for example.

Japanese laid-open Patent Publication (Kokai) No. 3-141839 discloses a technique for deriving the target throttle opening directly from the amount of depression of the accelerator pedal when the engine is in a non-loaded state, thereby to solve the problem of racing of the engine. Japanese laid-open Patent Publication (Kokai) No. 3-290027 discloses a technique for setting the target throttle opening to an appropriate value so as to achieve an effective engine brake. These techniques, however, cannot solve the above-described problem of the delay in the response.

SUMMARY OF THE INVENTION

The present invention was developed in the light of the above situations. It is therefore an object of the present invention to provide a throttle valve control device which is able to control the throttle opening based on operating conditions of the engine and the like, as well as an amount of depression of the accelerator pedal, wherein the throttle opening can be varied with a reduced delay in response to the accelerator pedal position, thus making the driver more comfortable while driving. To accomplish the above object, the present invention provides a throttle valve mounted in an intake pipe of an internal combustion engine; an actuator which drives the throttle valve so as to change an opening of the throttle valve; operating condition detecting means for detecting operating conditions of the internal combustion engine; accelerator position detecting means for detecting an accelerator pedal position that represents an amount by which an accelerator pedal is depressed by a a driver; first target opening setting means for setting a first target opening of the throttle valve based on the accelerator pedal position detected by the accelerator position detecting means; second target opening setting means for setting a second target opening of the throttle valve based on the accelerator pedal position detected by the accelerator position detecting means, and the operating conditions of the internal combustion engine detected by the operating condition detecting means; and throttle valve control means for comparing the first target opening set by the first target opening setting means, with the second target opening set by the second target opening setting means, and controlling the actuator based on the larger one of the first target opening and second target opening.

According to another aspect of the present invention, there is provided a throttle valve control device comprising: a throttle valve mounted in an intake pipe of an internal combustion engine; an actuator which drives the throttle valve so as to change an opening of the throttle valve; an operating condition sensor which detects operating conditions of the internal combustion engine; an accelerator sensor which detects an accelerator pedal position that represents an amount by which an accelerator pedal is depressed by a driver; a control unit which includes a first setting circuit that sets a first target opening of the throttle valve based on the accelerator pedal position detected by the accelerator sensor, a second setting circuit that sets a second target opening of the throttle valve based on the accelerator pedal position detected by the accelerator sensor, and the operating conditions of the engine detected by the operating condition sensor, and a control circuit that compares the first target opening set by the first setting circuit, with the second target opening set by the second setting circuit, and controls the actuator based on the larger one of the first target opening and second target opening.

According to a further aspect of the present invention, there is provided a throttle valve control method, comprising the steps of: detecting operating conditions of an internal combustion engine; detecting an accelerator pedal position that represents an amount by which an accelerator pedal is depressed by a driver; setting a first target opening of a throttle valve based on the detected accelerator pedal position; setting a second target opening of the throttle valve based on the detected accelerator pedal position, and the detected operating conditions of the internal combustion engine; and comparing the first target opening with the second target opening, and controlling an actuator for driving the throttle valve, based on the larger one of the first target opening and second target opening.

BRIEF DESCRIPTION OF THE DRAWINGS

FIGS. 5 and 5(A)–5(D) are time chart explaining the operation of the throttle valve control device of the embodiment of FIG. 1.

DETAILED DESCRIPTION OF THE PREFERRED EMBODIMENTS

Referring to FIG. 1 through FIG. 5, one preferred embodiment of the present invention in the form of a throttle valve control device will be described in detail.

Figure 1:
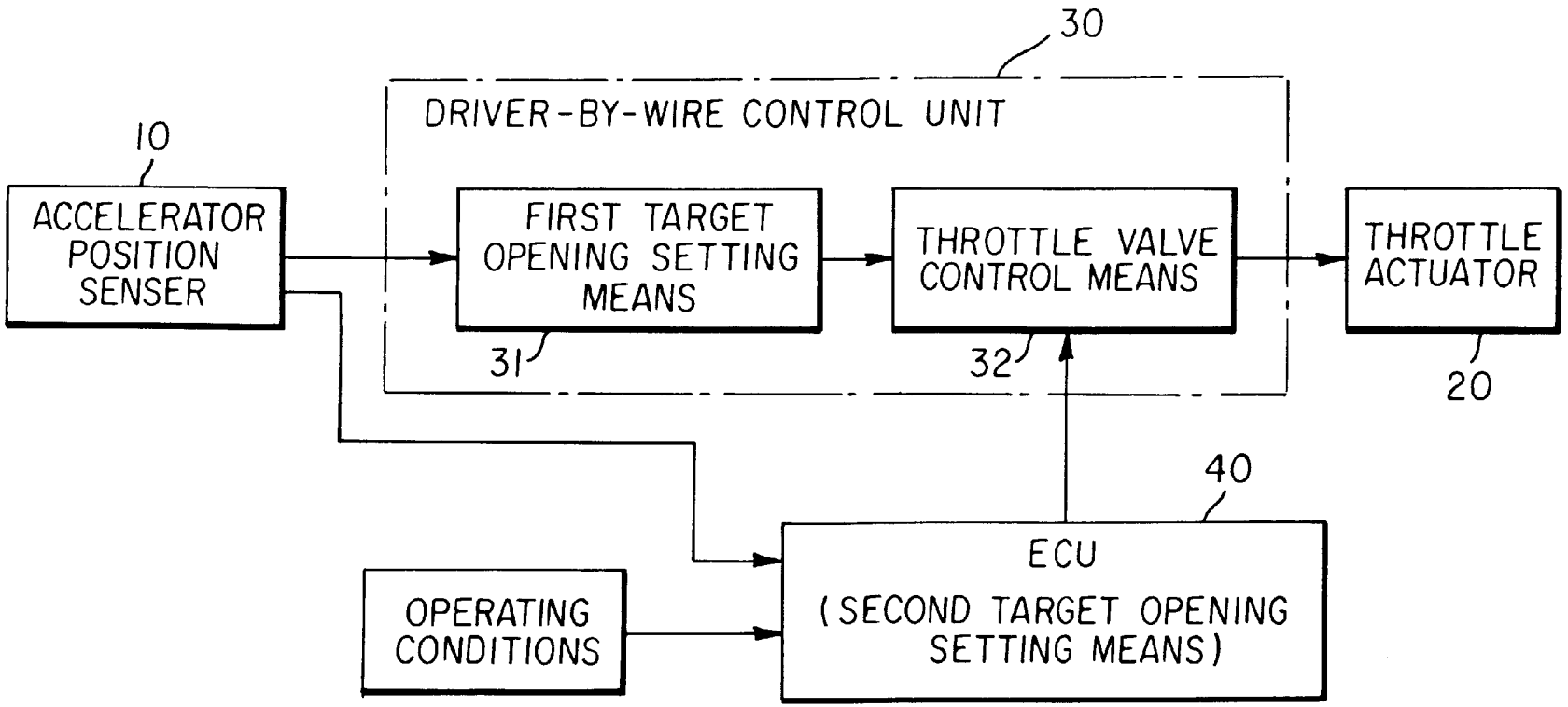
FIG. 1 is a schematic block diagram showing a throttle valve control device constructed according to one embodiment of the present invention.

In the control device of the present embodiment shown in FIG. 1, a signal (indicative of an accelerator pedal position) from an accelerator position sensor 10 serving as accelerator position detecting means is transmitted to an electronic control unit (ECU) 40 for controlling the engine, and a drive-by-wire control unit (throttle valve controller, hereinafter called DBW control unit) 30. In response to the signal from the accelerator position sensor 10, the ECU 40 and DBW control unit 30 are adapted to control a motor (throttle actuator) 20 for driving the throttle valve of the engine.

The DBW control unit 30 includes a first target opening setting means 31 that functions to set a pseudo target throttle opening (pseudo target TPS) as the first target opening in accordance with the signal indicative of the current accelerator pedal position detected by the accelerator position sensor 10.

This pseudo target throttle opening TPS is calculated at regular time intervals according to the following expressions, based on a pseudo accelerator position obtained by correcting the signal indicative of the accelerator pedal position APS detected by the accelerator position sensor 10 in accordance with operating conditions of the engine and other information.

$$\text{Pseudo target TPS } (n) = \text{virtual APS} \times K + (1-K) \times \text{pseudo target TPS } (n-1) + \text{TPS learn value} - \text{offset value} \quad (1)$$

where K is filter coefficient.

$$\text{Virtual APS} = [\text{APS input value (after learning)} - \text{APS fully-closed correction value}] \times C \quad (2)$$

where C is reflection coefficient.

In the above expression (1), (+TPS learned value−offset value) is a correction term, which will not be described in detail herein.

The virtual APS (accelerator pedal position) is obtained by multiplying the result of correction of the APS input value representing the amount by which the accelerator pedal is depressed by the driver, by the reflection coefficient C, as indicated by the expression (2). This reflection coefficient is a value (around 0.8, for example) less than 1.0, and the virtual APS is set to a value which is slightly lower than a value (input value from the accelerator position sensor 10) that corresponds to the amount of depression of the accelerator pedal by the driver.

The filter coefficient K, which defines the rate of change of the pseudo target throttle opening TPS (n), is a variable in this embodiment. If this filter coefficient K is large, changes in the position of the accelerator pedal operated by the driver (i.e., virtual APS) are quickly reflected by the pseudo target throttle opening TPS, namely, the pseudo target throttle opening TPS changes in high response to changes in the accelerator pedal position. If the filter coefficient K is small, changes in the position of the accelerator pedal operated by the driver are mitigated or reduced, and the pseudo target throttle opening TPS is changed relatively slowly.

On the other hand, the ECU 40 sets a target throttle opening TPS (which will be called ECU target throttle opening TPS) as the second target opening, by correcting the amount by which the accelerator pedal is depressed by the driver (namely, input value from the accelerator position sensor 10), in accordance with operating conditions of the engine and other information. The ECU 40 functions as second target opening setting means.

In this case, the operating conditions of the engine and other information may include information on the engine speed, and change gear ratio or gear position of the transmission system, for example. The ECU (second target opening setting means) 40 sets ECU target throttle opening TPS (second target opening) to a value which appropriately reflects not only the amount of depression of the accelerator pedal by the driver, but also operating conditions of the engine represented by the engine speed and selected gear position of the transmission.

The ECU target throttle opening set by the ECU 40 in this manner is transmitted to the DBW control unit 30.

The DBW control unit 30 includes throttle valve control means 32 that functions to compare a pseudo target throttle opening TPS (first target opening) set by the first target opening setting means 31, and the ECU target throttle opening TPS (second target opening) set by the ECU (second target opening setting means) 40, then selects the larger one of these target throttle openings, and control the operation of the actuator 20 based on the selected target throttle opening.

Figure 2:
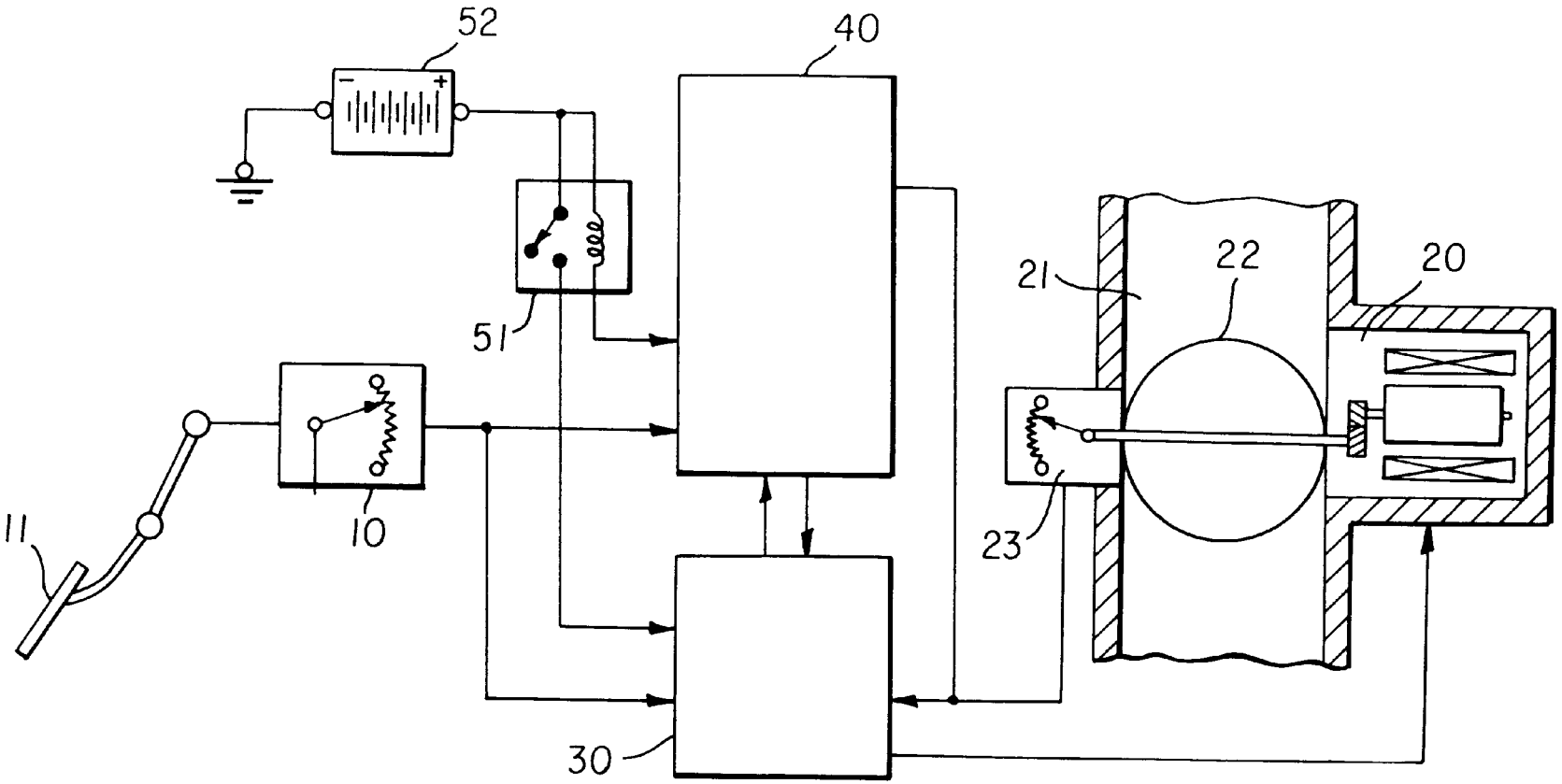
FIG. 2 is a view showing the construction of the throttle valve control device of the embodiment of FIG. 1.

The construction of the control device of the present embodiment is illustrated in FIG. 2.

The accelerator position sensor 10 serving as accelerator position detecting means detects the amount by which the accelerator pedal 11 is depressed by the driver (accelerator pedal position), and outputs the result of detection to the engine ECU (second target opening setting means) 40 and the throttle valve controller (DBW control unit) 30. Electric power is supplied from a battery 52 to the engine ECU 40 and throttle valve controller 30 via a throttle control relay 51 that operates in association with an ignition key.

A throttle valve 22, which is mounted in an intake air passage 21 of an intake pipe, is driven by the throttle control servo motor (throttle actuator) 20, and its opening is controlled by this motor. The actuator 20 operates in a controlled manner in response to a control signal (power supply) from the throttle valve controller 30. A throttle position sensor 23 serves to detect the throttle opening, or opening angle of the throttle valve 22, and the throttle valve controller 30 controls the actuator 20 based on information on the throttle position detected by the throttle position sensor 23. The information on the throttle opening is also transmitted from the throttle position sensor 23 to the engine ECT 40, to be utilized for engine control.

Figure 3:
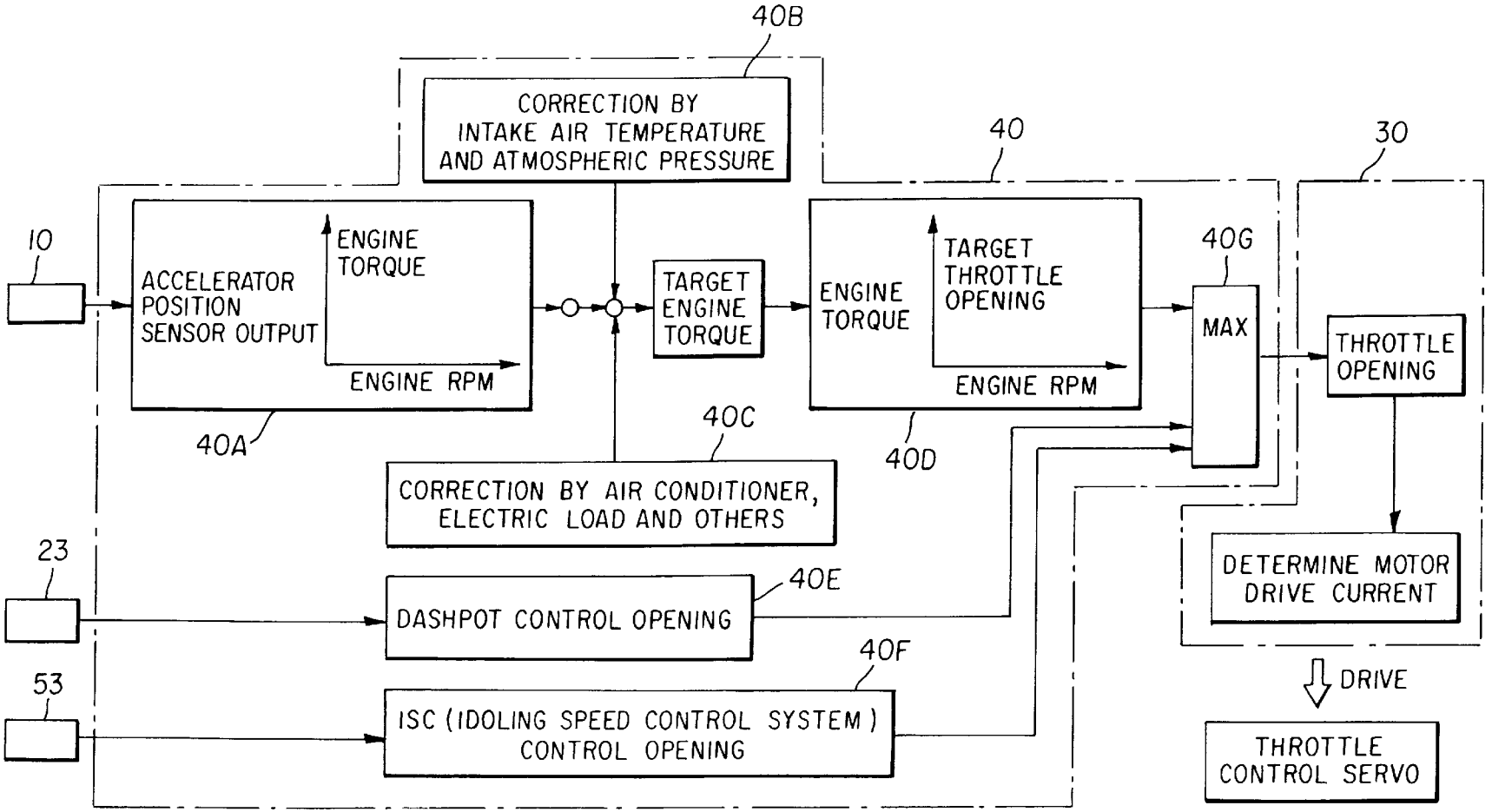
FIG. 3 is a block diagram showing the configuration of a control system of the throttle valve control device of the embodiment of FIG. 1.

The processing of ECU 40 will be explained in greater detail. As shown in FIG. 3, ECU 40 sets a target engine torque based on the amount of depression of the accelerator pedal detected by the acceleration position sensor 10, and the engine speed, as indicated at 40A. The target engine torque is then corrected in terms of the intake air temperature and atmospheric pressure (as indicated at 40B), and also in terms of the air conditioner, electric load, and other factors (as indicated at 40C). The target throttle opening is determined based on the target engine torque that has been corrected in this manner and the engine speed, as indicated at 40D in FIG. 3.

Also, the throttle opening at which dashpot control is performed is determined (as indicated at 40E) based on information (throttle position) from the throttle position sensor 23 (40E), and the throttle opening at which idle speed control is performed is determined (as indicated at 40F) based on a coolant temperature of the engine that is detected by a water temperature sensor 53.

The ECU 40 selects the maximum value from these throttle openings determined as described above (40E), and outputs the selected throttle opening to the throttle valve controller 30.

The throttle valve controller 30 determines a motor drive current in accordance with the target throttle opening transmitted from the ECU 40, and drives/controls the throttle control servo motor (actuator) 20 with this current.

Figure 4:
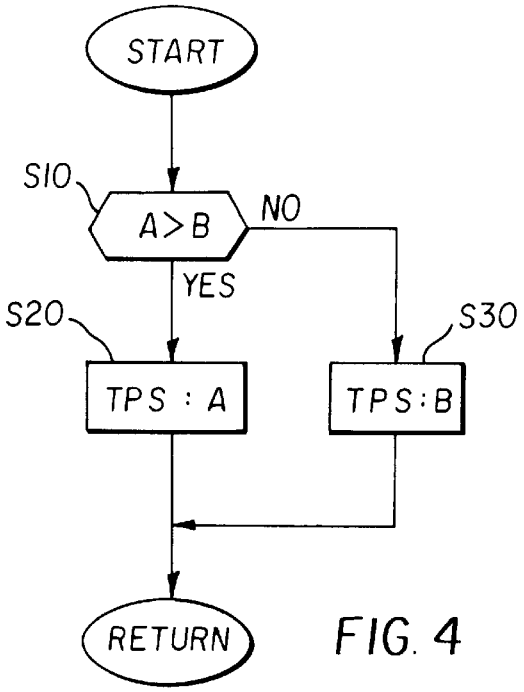
FIG. 4 is a flow chart explaining the operation of the throttle valve control device of the embodiment of FIG. 1.
Figure 6:
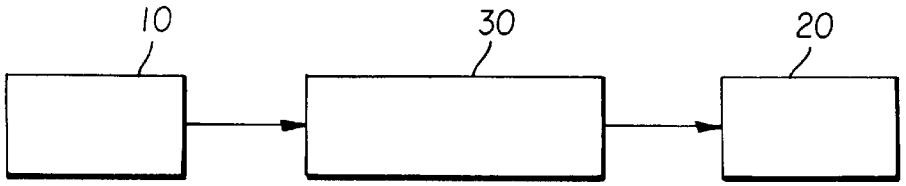
FIG. 6 is a schematic block diagram showing a known example of throttle valve control device.
Figure 7:
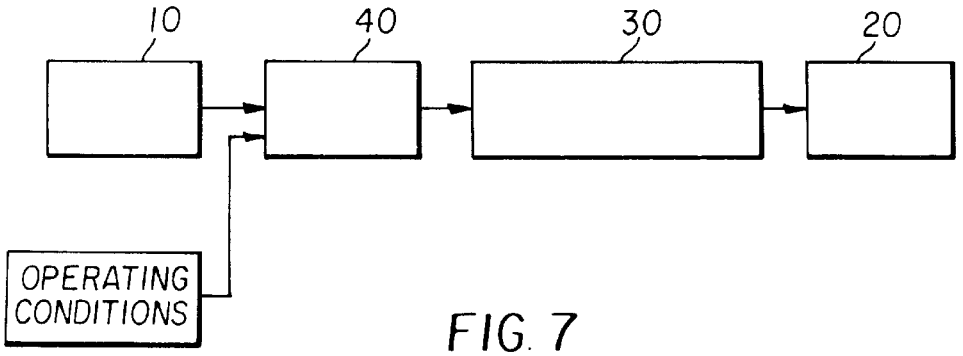
FIG. 7 is a schematic block diagram showing another known example of throttle valve control device.
Figure 5:
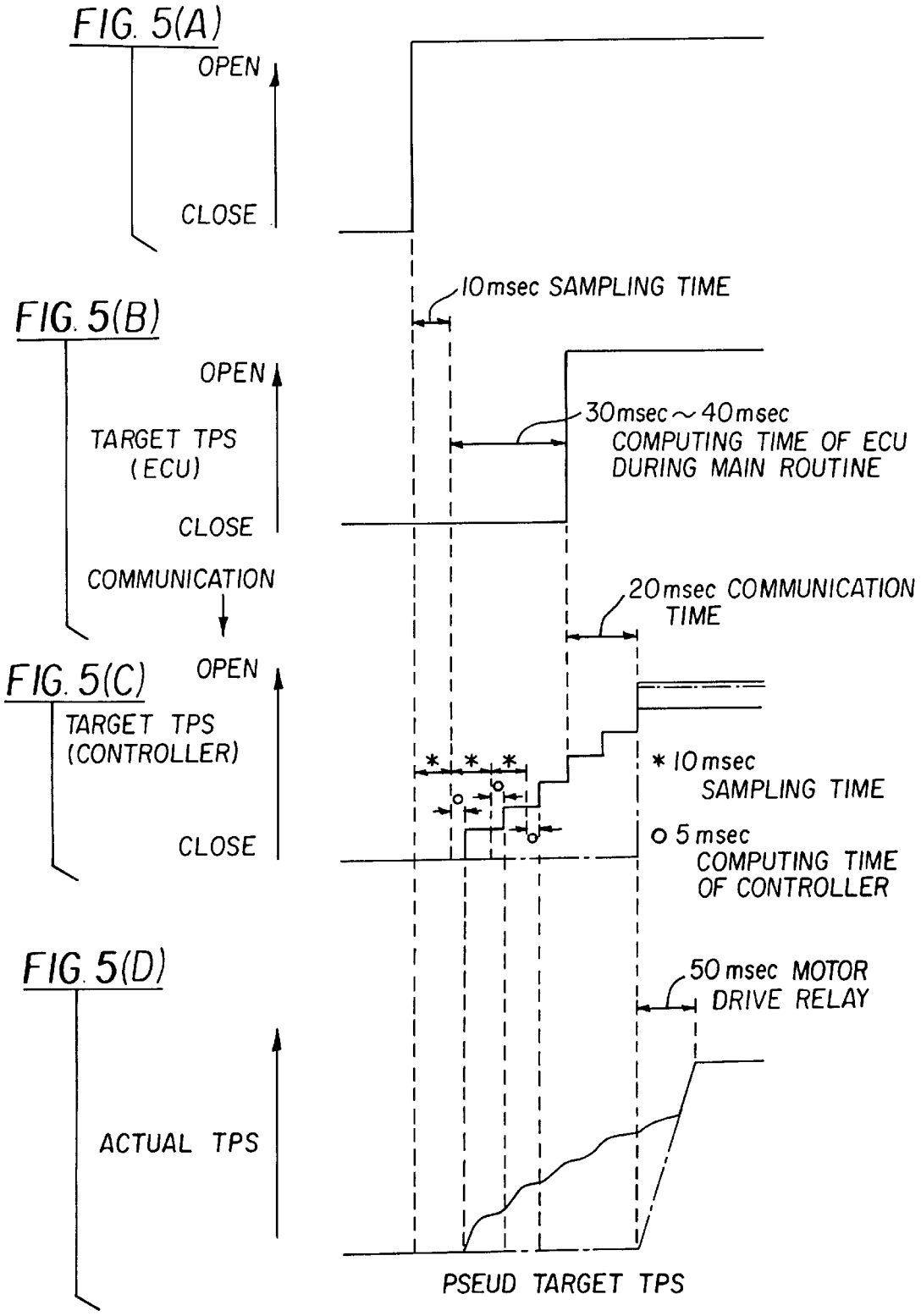

In the throttle valve control device of the present embodiment constructed as described above, the throttle valve control means 32 of the throttle valve controller 30 compares the pseudo target throttle opening TPS (first target opening) A set by the first target opening setting means 30 and the EPU target throttle opening TPS (second target opening) B set by the ECU (second target opening setting means) 40 in step S10 of FIG. 4, and selects the first target opening A if the first target opening A is larger than the second target opening B in step S20 and selects the second target opening B if the second target opening B is larger than the first target opening A in step S30. The selected target opening is used for controlling driving of the throttle control servo motor (actuator) 20. This control is performed while regularly retrieving information from the accelerator position sensor 10 at a predetermined sampling time (for example, 10 msec).

When the accelerator pedal is shifted step by step from a fully released position to a fully depressed position as shown in FIG. 5(A), the ECU (second target opening setting means) 40 receives information on the position of the accelerator pedal (i.e., change from the fully released position to the fully depressed position) from the accelerator position sensor 10 within a sampling time (for example, 10 msec), and calculates the ECU target throttle opening TPS (second target opening) B.

The ECU (second target opening setting means) 40 sets the target throttle opening TPS (second target opening) B immediately after receiving from the accelerator position sensor 10 the information that the accelerator pedal has been shifted from the fully released position to the fully depressed position, as shown in FIG. 5(B). The ECU 40, however, computes the target throttle opening TPS (second target opening) B as a part of the main routine associated with engine control, and therefore it takes about 30–40 msec to compute this target opening B.

Accordingly, the target throttle opening TPS (second target opening) B starts being increased with a delay substantially equal to the sum of the sampling time (10 msec) and the computing time (30–40 msec), as measured from a point of time when the fully depressed position of the accelerator pedal is detected by the accelerator position sensor 10. Taking account of the communication time from the ECU 40 to the throttle valve controller 30 (for example, 20 msec), it takes time TT as calculated below until the throttle valve controller 30 reflects the increase of the target throttle opening TPS (second target opening) B.

*TT*=sampling time (10 msec)+computing time (30–40 msec)+communication time (20 msec)

In the above case where the accelerated pedal is shifted step by step from the fully released position to the fully depressed position, as shown in FIG. 5(A), the first target opening setting means 31 of the throttle valve controller 30 also receives from the accelerator position sensor 10 the information on the accelerator pedal position (change from the fully released position to the fully depressed position), and computes the pseudo target throttle opening TPS (first target opening) A, as indicated by a solid line in FIG. 5(C). Although it takes a certain amount of time to compute this target throttle opening A, this computing time (for example, about 5 msec) is shorter than the time required for computation of the ECU target throttle opening TPS (second target opening) B as indicated by a chain line in FIG. 5(C), which is performed as a part of the main routine. Namely, the operation speed of the first target opening setting means 31 is set to be higher than that of the ECU (second target opening setting means) 40.

Accordingly, the pseudo target throttle opening TPS (first target opening) A starts being increased with a delay substantially equal to the sum of the sampling time (10 msec) and the computing time (5 msec), as measured from a point of time when the fully depressed position of the accelerator pedal is detected by the accelerator position sensor 10.

As a result, the throttle valve control means 32 of the throttle valve controller 30 initially sets the target throttle opening to the pseudo target throttle opening TPS (first target opening) A that is calculated according to the expression (1), as shown in FIG. 5(C). When the throttle valve control means 32 receives the increased ECU target throttle opening TPS (second target opening) B upon a lapse of time TT after the accelerator position sensor 10 detects the fully depressed position, the control means 32 determines that the ECU target throttle opening TPS (second target opening) B is greater than the target throttle opening TPS (first target opening) A, and sets the target throttle opening to the ECU target throttle opening TPS (second target opening) B.

If the throttle opening is controlled according to the target throttle opening thus selected, the actual throttle opening (actual TPS) increases with a delay associated with driving of the motor, as shown in FIG. 5(D).

In the conventional throttle control device, an increase of the actual throttle opening TPS is largely delayed, and then a step-like, rapid increase occurs, as indicated by a chain line in FIG. 5(D). In the throttle valve control device of the present embodiment, on the other hand, the actual throttle opening TPS starts increasing at an earlier point of time, and does not increase rapidly or abruptly.

As described above, the throttle valve control means 32 of the throttle valve controller 30 selects the larger one of the pseudo target throttle opening TPS (first target opening) A and ECU target throttle opening TPS (second target opening) B, and controls the throttle opening based on the selected target throttle opening TPS. When the vehicle is accelerated, therefore, the present throttle valve control device can readily increase the throttle opening without a large delay, by initially selecting the pseudo target throttle opening TPS (first target opening) A that starts increasing relatively quickly, even if the increase of the ECU target throttle opening TPS (second target opening) B is delayed due to the additional computing time (30–40 msec) and communication time (20 msec). This makes the driver more comfortable when he/she depresses the accelerator pedal to accelerate the automobile.

Further, the computation of the pseudo target throttle opening TPS (first target opening) A involves the filter coefficient K (as indicated in the expression (1)) so as to ensure moderate increases of the target throttle opening (TPS) A, the pseudo target throttle opening TPS itself does not increase rapidly, and the actual throttle opening is also prevented from rapidly increasing when the selection of the throttle valve control means 32 is switched from the pseudo target throttle opening TPS (first target opening) A to the ECU target throttle opening TPS (second target opening) B upon a lapse of the computing time (30–40 msec) and communication time (20 msec).

When the vehicle is running at a fixed speed, or is accelerated slowly, the throttle valve controller 30 controls the throttle opening based on the target throttle opening TPS calculated based on the amount of depression of the accelerator pedal and operating conditions of the engine, and therefore the throttle valve can be controlled with further improved accuracy.

What is claimed is:

1. A throttle valve control device comprising:

a throttle valve mounted in an intake pipe of an internal combustion engine;

an actuator which drives the throttle valve so as to change an opening of the throttle valve;

operating condition detecting means for detecting operating conditions of the internal combustion engine;

accelerator position detecting means for detecting an accelerator pedal position that represents an amount by which an accelerator pedal is depressed by a driver;

first target opening setting means for setting a first target opening of said throttle valve based on the accelerator pedal position detected by said accelerator position detecting means;

second target opening setting means for setting a second target opening of said throttle valve based on the accelerator pedal position detected by said accelerator position detecting means, and the operating conditions of the internal combustion engine detected by said operating condition detecting means; and throttle valve control means for comparing the first target opening set by said first target opening setting means, with the second target opening set by said second target opening setting means, and controlling said actuator based on the larger one of the first target opening and second target opening.

2. A throttle valve control device according to claim 1, wherein said first target opening setting means calculates a corrected accelerator pedal position which indicates an amount of depression of the accelerator pedal that is smaller than that detected by said accelerator position detecting means, and sets the first target opening based on the corrected accelerator pedal position.

3. A throttle valve control device according to claim 1, wherein said first target opening setting means and said second target opening setting means perform operations at regular intervals, and an operation speed of the second target opening setting means is set to be higher than an operation speed of the first target opening setting means.

4. A throttle valve control device according to claim 1, wherein the operating conditions of the internal combustion engine include at least a rotating speed of the internal combustion engine.

5. A throttle valve control device comprising;

a throttle valve mounted in an intake pipe of an internal combustion engine;

an actuator which drives said throttle valve so as to change an opening of the throttle valve;

an operation condition sensor which detects operating conditions of the internal combustion engine;

an accelerator sensor which detects an accelerator pedal position that represents an amount by which an accelerator pedal is depressed by a driver; and a control unit which includes a first target opening setting means that sets a first target opening of said throttle valve based on the accelerator pedal position detected by said accelerator sensor, a second target opening setting means that sets a second target opening of said throttle valve based on the accelerator pedal position detected by said accelerator sensor, and the operation conditions of the engine detected by said operating condition sensor, and a control circuit that compares the first target opening set by said first target opening setting means, with the second target opening set by said second target opening setting means, and controls said actuator based on the larger one of the first target opening and second target opening.

6. A throttle valve control method, comprising the steps of:

detecting operating conditions of an internal combustion engine;

detecting an accelerator pedal position that represents an amount by which an accelerator pedal is depressed by a driver;

setting a first target opening of a throttle valve based on the detected accelerator pedal position;

setting a second target opening of the throttle valve based on the detected accelerator pedal position, and the detected operating conditions of the internal combustion engine; and comparing the first target opening with the second target opening, and controlling an actuator for driving the throttle valve, based on the larger one of the first target opening and second target opening.

7. A throttle valve control method according to claim 6, wherein the first target opening is set based on a corrected accelerator pedal position which indicates an amount of depression of the accelerator pedal that is smaller than that detected in said step of detecting an accelerator pedal position.

8. A throttle valve control method according to claim 6, wherein operations for setting the first target opening and the second target opening are performed at regular intervals, and the first target opening is computed at a first operation speed, while the second target opening is computed at a second operation speed that is higher than the first operation speed.

9. A throttle valve control method according to claim 6, wherein the operating conditions of the internal combustion engine include at least a rotating speed of the internal combustion engine.

* * * * *

UNITED STATES PATENT AND TRADEMARK OFFICE

CERTIFICATE OF CORRECTION

PATENT NO. : 5,983,861
DATED : November 16, 1999
INVENTOR(S) : Nishio, et al.

It is certified that error appears in the above-identified patent and that said Letters Patent is hereby corrected as shown below:

On the title page, item [73] Assignee:

Please insert --KAISHA-- after KABUSHIKI.

Signed and Sealed this

Eleventh Day of July, 2000

*Attest:*

Q. TODD DICKINSON

*Attesting Officer*

*Director of Patents and Trademarks*